US008646122B2

(12) United States Patent
Ton

(10) Patent No.: US 8,646,122 B2
(45) Date of Patent: Feb. 11, 2014

(54) SPA TUB APPARATUS AND SYSTEM USING AIR JET

(76) Inventor: Huy That Anh Ton, Miami, FL (US)

( * ) Notice: Subject to any disclaimer, the term of this patent is extended or adjusted under 35 U.S.C. 154(b) by 1143 days.

(21) Appl. No.: 12/606,177

(22) Filed: Oct. 26, 2009

(65) Prior Publication Data

US 2011/0094026 A1 Apr. 28, 2011

(51) Int. Cl.

| | |
|---|---|
| ***A47K 3/022*** | (2006.01) |
| ***A61H 35/00*** | (2006.01) |
| ***E03C 1/00*** | (2006.01) |

(52) U.S. Cl.

USPC ..... 4/622

(58) Field of Classification Search

USPC ..... 4/619–660

See application file for complete search history.

(56) References Cited

U.S. PATENT DOCUMENTS

| | | | | |
|---|---|---|---|---|
| 3,538,950 | A | 11/1970 | Porteners | |
| 4,430,762 | A | 2/1984 | Marshall | |
| 5,414,878 | A | 5/1995 | Booth | |
| 6,836,908 | B1 | 1/2005 | Chang | |
| 7,950,079 | B2 * | 5/2011 | Ta | 4/622 |
| 2006/0242760 | A1 * | 11/2006 | Chao | 4/622 |
| 2007/0000054 | A1 | 1/2007 | Fanuzzi | |
| 2007/0056087 | A1 * | 3/2007 | Vinokur et al. | 4/541.5 |
| 2008/0276365 | A1 | 11/2008 | Ton | |
| 2009/0044330 | A1 | 2/2009 | Ta | |
| 2009/0105618 | A1 * | 4/2009 | Ta | 601/49 |

FOREIGN PATENT DOCUMENTS

| | | |
|---|---|---|
| DE | 3248174 A1 | 7/1984 |
| DE | 3840915 C1 | 3/1990 |
| JP | 49-61125 U1 | 5/1974 |

OTHER PUBLICATIONS t4® Pedicure Spa Use & Care Manual, Dec. 15, 2008, 28 pages, published by T4 Spa Concepts & Designs, LLC, Baton Rouge, LA.

American Beauty Equipment, "The Pedi Lounge" web page, accessed Aug. 4, 2009, published on the Internet by midwestsalon.com at http://www.midwestsalon.com/Gulfstream%20Pedicure%20Lounge%20Featuring%20The%20Pedicure%20Bowl%20In%20Many%20Colors%20and%20Pipeless%20Jets.htm.

Central Pneumatic 5 Piece Solid Brass Quick Coupler Set web page, ITEM 42444-2VGA, accessed Sep. 14, 2009, published on the Internet by Harbor Freight at http://www.harborfreight.com/cpi/ctaf/displayitem.taf?Itemnumber=42444.

* cited by examiner

*Primary Examiner* — Lori Baker

(74) *Attorney, Agent, or Firm* — Diederiks & Whitelaw, PLC

(57) ABSTRACT

A pedicure spa tub sanitary apparatus and system includes a disposable spa tub basin liner and a disposable gas jet member that includes a quick-connect coupling for easy assembly and removal after each use. The spa tub basin liner is made from plastic and conforms to the shape of the spa tub. The disposable gas jet member is also preferably made from plastic or other rigid material and cooperates with a valved gas coupling member secured in the spa basin wall to provide a safe and sanitary air jetting function when the spa tub basin is filled with water, thereby reducing the risk of spreading infectious disease. During use, the disposable gas jet member may be disposed within a wall trough of the spa tub to protect the disposable gas jet member and quick-connect coupling from accidental breakage and/or disconnection.

18 Claims, 8 Drawing Sheets

SPA TUB APPARATUS AND SYSTEM USING AIR JET

BACKGROUND OF THE INVENTION (1) Field of the Invention

This invention pertains to the field of spa tubs and basins. More particularly, this invention pertains to the field of sanitary systems, arrangements, and apparatuses for use with or in spa tubs and basins having jetting functions, such as are commonly found in pedicure lounges, chairs, and spas.

(2) Description of the Related Art

A wide variety of spa jets have been invented and used in pedicure spas. Commonly, a pedicure spa tub has a water outlet and a water inlet. Water is drained from the pedicure tub and pumped through pipes and then recirculated through water jets to be directed at the spa user's feet. Unfortunately, the residual (dirty) water from a previous user can remain in the pipe system and possibly allow bacteria and fungus to grow within the pipes and the jet head. Even though the tub is thoroughly cleaned, the residual water may be pumped out, mixed and then circulated with the new clean water. This type of spa tub apparatus using the traditional pipe and jet system could cause the spread of infection to the next user. Therefore, the risk and potential for epidemic outbreaks of bacteria, fungi and viruses is a cause of concern for the public.

In the field of pedicure lounges, chairs, and spas, disposable liners with drain caps are known. See for example the SaniSmart™ disposable spa liners disclosed in the "$T^4$ Pedicure Spa Use and Control Manual", 2008, incorporated by reference herein in its entirety and also for showing the drain cap structure. See also United States Patent Application Publication 2008/0276365 to Ton, incorporated by reference herein in its entirety.

In the field of pedicure lounges, chairs, and spas, the use of disposable liners in conjunction with forced air or gas circulating systems is known from United States Patent Application Publication 2009/0044330 to Ta (note, for example, the description of the embodiment of FIG. 4B at paragraphs [0037] to [0039]) and United States Patent Application Publication 2007/0056087 to Vinokur et al., both of which are incorporated by reference herein in their entirety.

Quick-connect couplings for gas and other fluids are known, per se. Many types of quick-connect couplings exist. For example, U.S. Pat. No. 3,538,950 to Porteners reveals a quick-connect coupling of the bayonet type, and Japanese Published Utility Model 49-61125 U1 reveals a quick-connect coupling of the push (biased sleeve) type which may be used with the present invention. Both these patent documents are incorporated by reference herein in their entirety for showing details relating to quick-connect couplings. A suitable quick-connect coupling which may be used in conjunction with the present invention is also available from Harbor Freight USA as Item 42444, Central Pneumatic® Quick Coupler Brass Set.

BRIEF SUMMARY OF THE INVENTION

In one respect the invention relates to a sanitary apparatus for use with a spa basin. The spa basin has a basin wall including a peripheral wall portion and a bottom wall portion. The spa basin further includes a gas source, a gas coupling member disposed in the spa basin wall above a liquid fill level, and a drain disposed in the bottom wall portion for draining liquid from the spa basin. The sanitary apparatus includes a disposable water-proof liner adapted to conform to a shape of the spa basin wall, the disposable water-proof liner being adapted to extend above the liquid fill level and including a drain structure cooperating with the spa basin drain. The sanitary apparatus further includes a gas jet member adapted to be quickly coupled to the spa basin gas coupling member in the spa basin wall. The gas jet member includes a quick-connect coupling member at one end thereof for cooperating with the gas coupling member in the spa basin wall, a tubular extension adapted to carry gas from the quick-connect coupling member to a position below the liquid fill level, and a gas jet head connected to the tubular extension and adapted to emit a gas stream carried from the tubular extension of the gas jet member into the spa basin.

In another respect the invention relates to a spa tub apparatus including a spa basin having a basin wall and a gas source, wherein the spa basin wall includes a peripheral wall portion and a bottom wall portion, and wherein the spa basin is adapted to be filled to a liquid fill level. The spa basin further includes a gas coupling member secured in the spa basin wall above the liquid fill level and connected to the gas source, and a drain disposed in the bottom wall portion for draining liquid from the spa basin. The spa tub apparatus further includes a disposable water-proof liner adapted to conform to a shape of the spa basin wall, the disposable water-proof liner including a drain structure cooperating with the spa basin drain. The spa tub apparatus further includes a gas jet member adapted to be quickly coupled to the spa basin gas coupling member in the spa basin wall, the gas jet member including a quick-connect coupling member at one end thereof for cooperating with the gas coupling member in the spa basin wall, a tubular extension adapted to carry gas from the quick-connect coupling member to a position below the liquid fill level, and a gas jet head connected to the tubular extension and adapted to emit a gas stream carried from the tubular extension of the gas jet member into the spa basin.

The invention will, however, be more fully understood by a reading of the following detailed description in conjunction with the accompanying drawings, in which:

DETAILED DESCRIPTION OF THE PREFERRED EMBODIMENT(S) OF THE INVENTION

Figure 1:
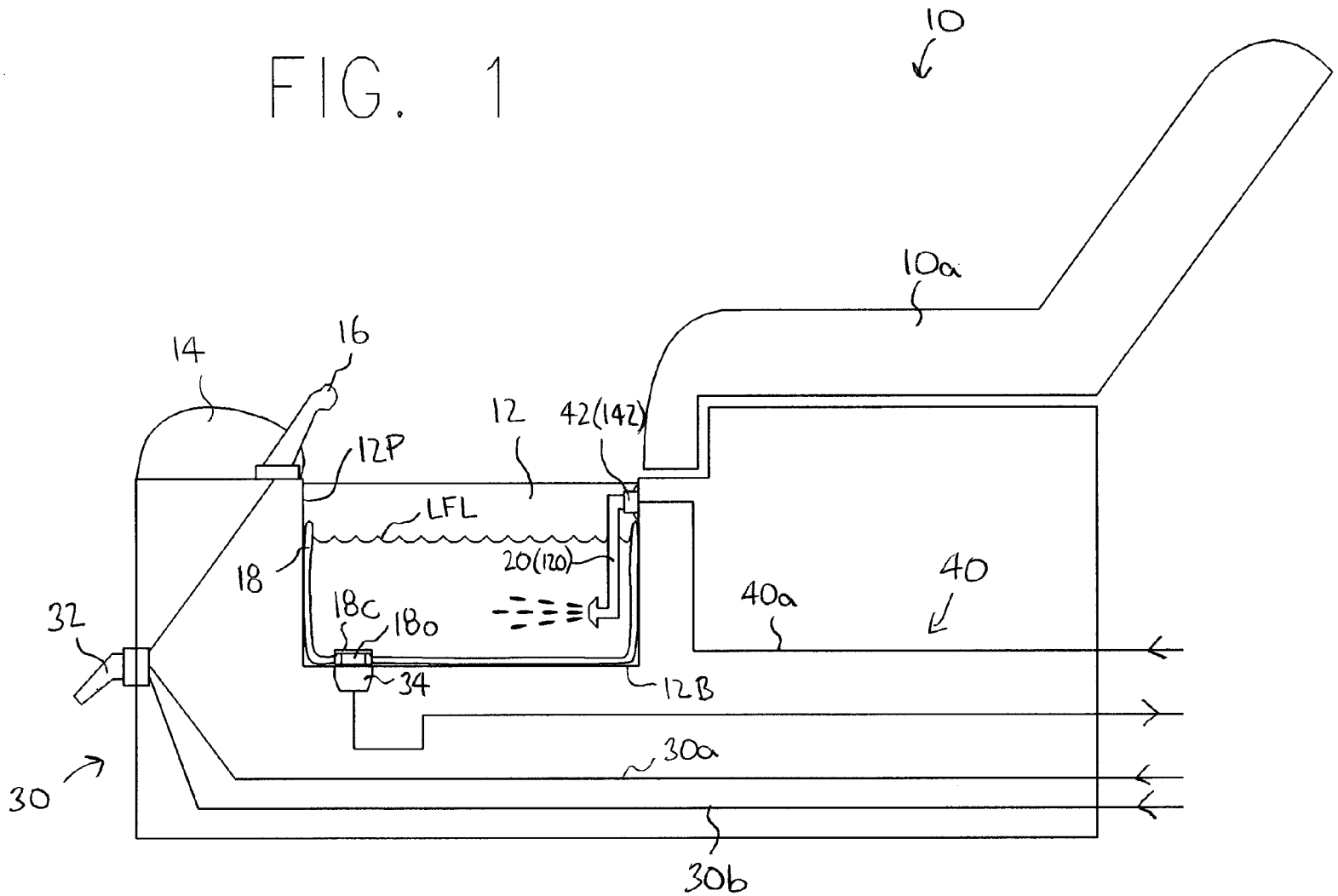
FIG. 1 is a schematic side view of a pedicure lounge chair showing a system according to a first embodiment of the invention in operation.

Referring now to the drawings in which like reference characters indicate like elements throughout, there is shown in FIGS. 1 to 4 a pedicure lounge chair 10 having a seat cushion 10*a* and equipped with a spa tub or basin 12, a foot rest 14, a water supply outlet or nozzle 16, and, according to a first embodiment of the invention, a disposable water-proof liner 18 and a disposable gas jet member 20 (120). The spa tub or basin 12 is adapted to be filled with water or other liquid up to a liquid fill level (shown at LFL) which is below the top edge of the disposable water-proof liner 18. A water supply source 30 includes hot and cold water lines 30*a*, 30*b* and a manually operated mixer valve 32. A drain 34 is provided at a bottom wall 12B of the spa tub or basin 12 for draining (via a drain line) the water or other liquid from the spa tub or basin 12. A gas source 40 includes a gas supply line 40*a*. The gas supply line 40*a* is connected to a gas coupling member 42 (142) secured within a hole or bore provided in a portion of the peripheral wall 12P of the spa tub or basin 12 at a position above the liquid fill level LFL. The gas coupling member 42 (142), which thus extends through (e.g., a generally vertical section of) the peripheral wall 12P of the spa tub or basin 12, is secured to the spa tub or basin 12 by caulking or similar construction. The gas supply line 40*a* may be connected to a gas compressor, a compressed air tank, or an accumulator for compressed air (none of which are shown); these elements may be provided as part of the pedicure lounge chair 10, or separately therefrom. In the event that a high-power gas compressor is provided, it may supply compressed gas to more than one spa tub or basin simultaneously. A manually-operated switch (not shown) on the pedicure lounge chair 10 can control, e.g., by a valve or electrically, the presence of gas pressure in the gas supply line 40*a*. When gas pressure is present in the gas supply line 40*a*, an emission of one or more gas streams into the spa tub or basin 12 is produced through the disposable gas jet member 20 (120) in order to create a pleasant or soothing sensation for the spa user.

Figure 2:
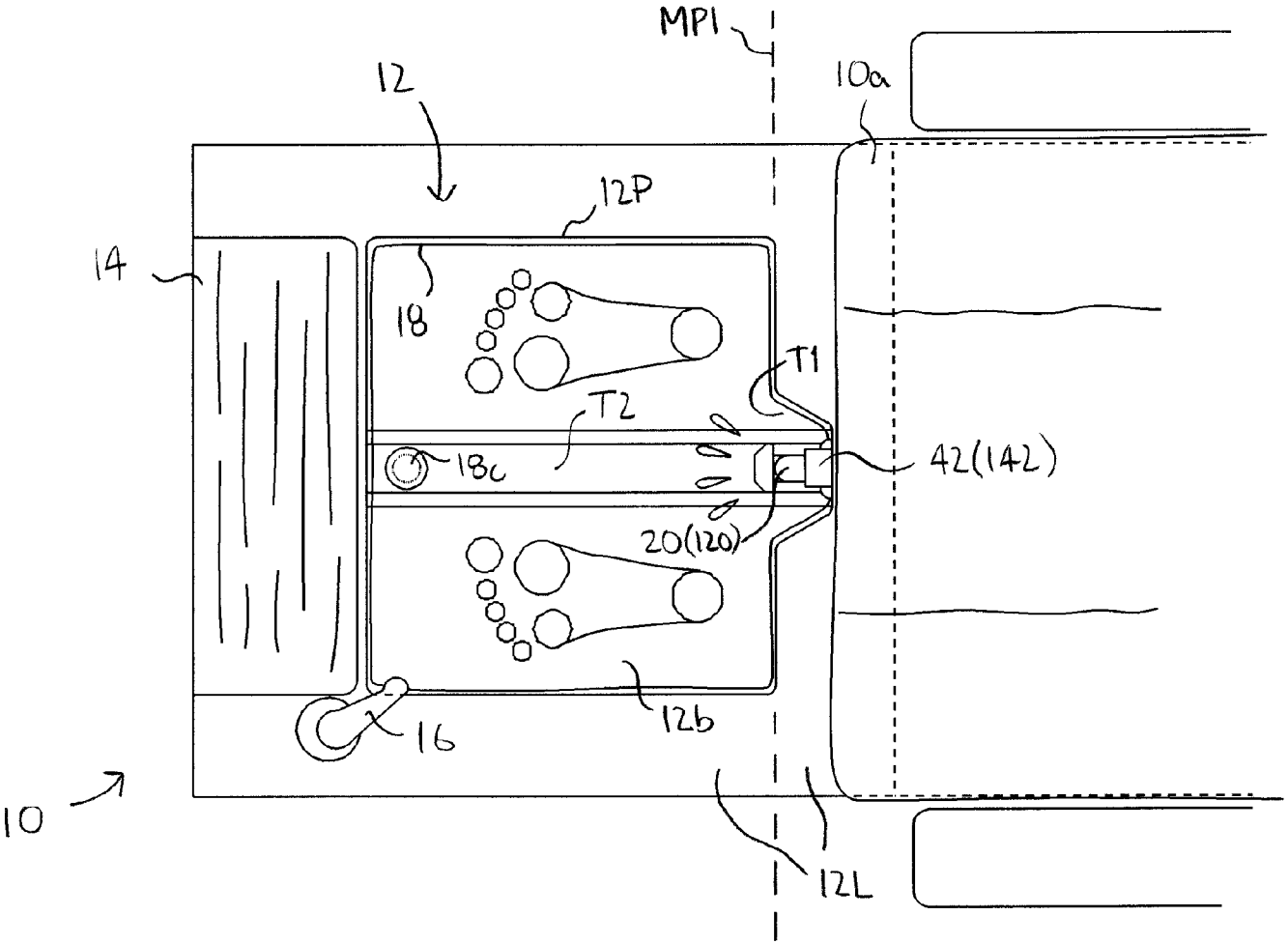
FIG. 2 is a partial top view of the pedicure lounge chair shown in FIG. 1.
Figure 3:
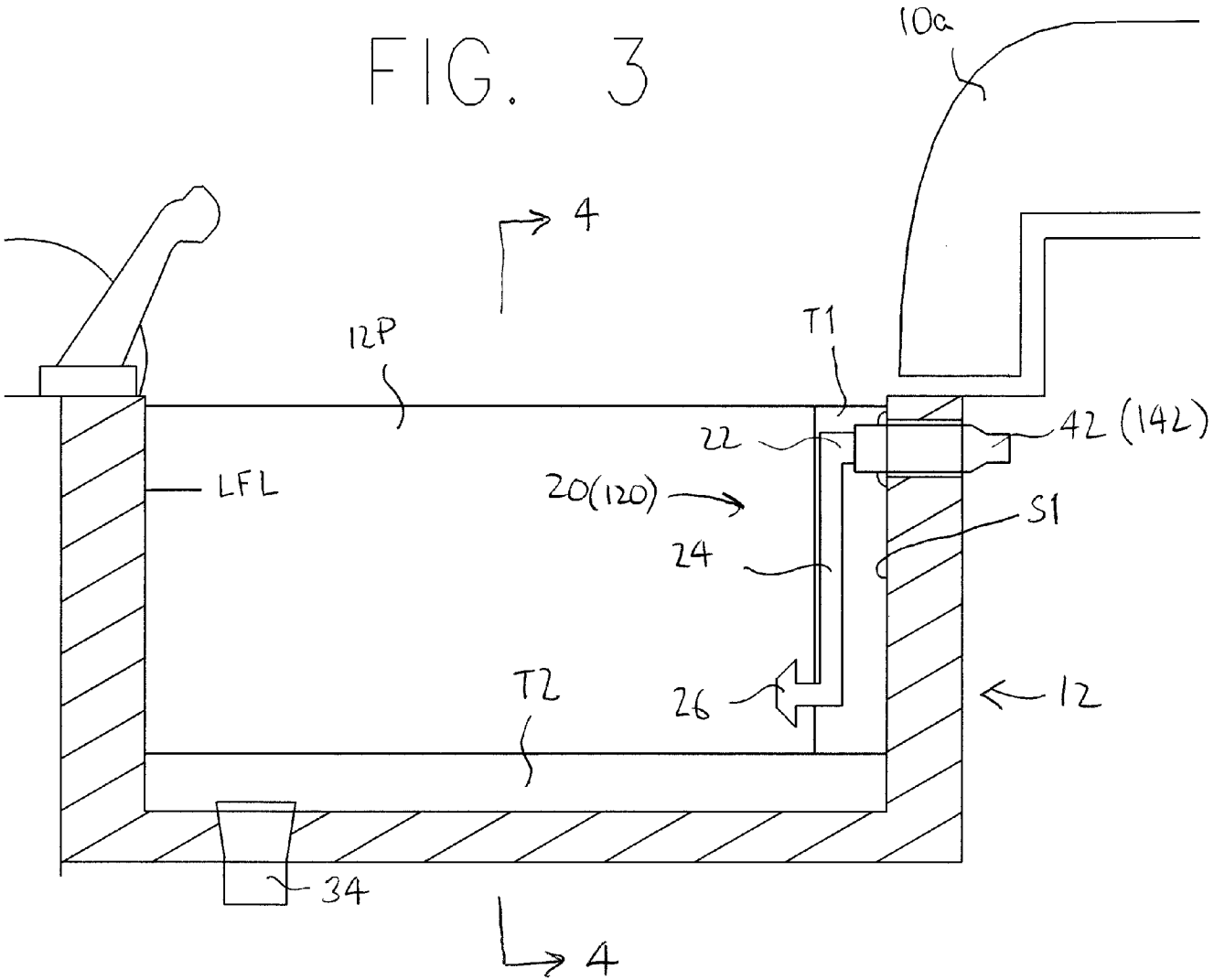
FIG. 3 is a detailed partial longitudinal cross-section of the spa tub shown in FIGS. 1 and 2, e.g., without the disposable liner installed or water present in the spa tub.
Figure 4:
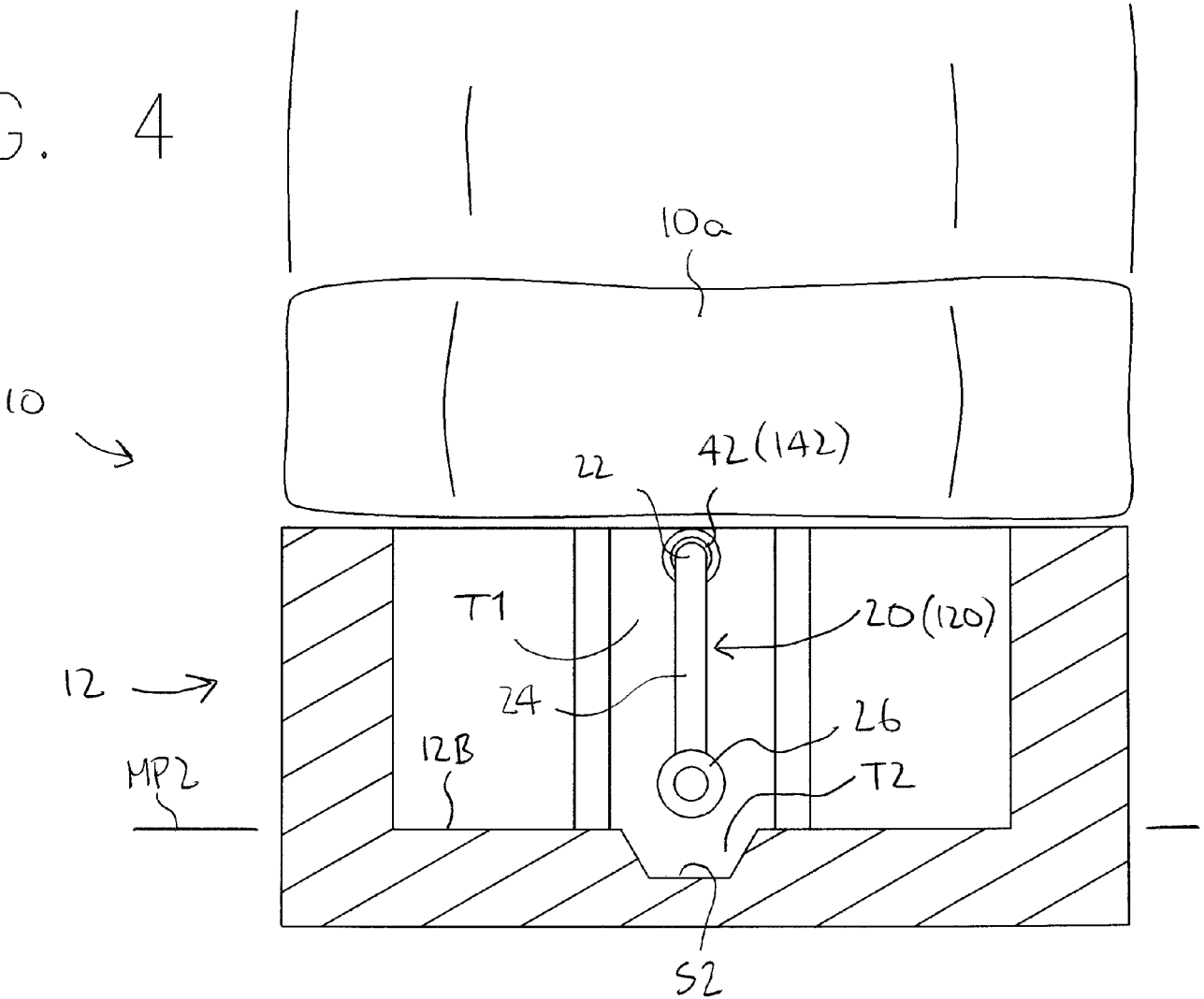
FIG. 4 is a partial transverse cross-section, taken along line 4-4 in FIG. 3 of the spa tub shown in FIGS. 1 and 2.

The shape of the spa tub or basin 12 according to the preferred embodiment of the invention is shown more particularly in FIGS. 2, 3, and 4. As noted above, the spa tub or basin 12 has a vertical (or generally vertically extending) peripheral wall 12P which extends entirely around the periphery of the spa tub or basin 12, and a bottom wall 12B which extends horizontally (or generally horizontally) across the entire area of the spa tub or basin 12. The peripheral wall 12P preferably includes, at its uppermost extent, a short horizontal lip portion 12L immediately adjacent (e.g., within 6 inches of) the top of the spa tub or basin 12.

As such, the spa tub or basin 12 shown in FIGS. 1 to 4 is generally parallelepiped in shape. Notably, however, in the preferred embodiment of the invention a pair of troughs T1, T2 are provided in the peripheral wall 12P and the bottom wall 12B, respectively, of the spa tub or basin 12. The first trough T1 is a wall trough and is defined as a recess in a major plane MP1 (FIG. 2) of the peripheral wall portion 12P of the spa tub or basin 12 (e.g., the major plane closest to the seat cushion 10*a*). That is, the wall trough T1 defines a volume of the spa tub or basin 12 that is recessed from the major plane MP1, and located between the major plane MP1 and a bottom (rightmost in FIGS. 2 and 3) surface S1 (FIG. 3) of the wall trough. The second trough T2 is a floor trough and is defined as a recess in a major plane MP2 (FIG. 4) of the bottom wall portion 12B of the spa tub or basin 12. That is, the floor trough T2 defines a volume of the spa tub or basin 12 that is recessed from the major plane MP2, and located between the major plane MP2 and a bottom surface S2 (FIG. 4) of the floor trough.

The disposable water-proof liner 18 is, in the preferred embodiment of the invention, made from plastic and conforms to the shape of the spa tub or basin 12. The disposable water-proof liner 18 may be rigid or substantially rigid and may be molded to conform to the shape of the spa tub or basin 12. Alternately, the disposable water-proof liner 18 may be flexible (and even stretchable), being made to conform to the shape of the spa tub or basin 12 by molding, or by the effects of the water pressure in the basin, or both. If the water-proof liner 18 is rigid or substantially rigid, the peripheral wall portions (e.g. of the liner and/or the spa tub or basin) may be slightly tapered to facilitate nesting and storage (e.g., prior to use and/or prior to disposal or recycling). If the water-proof liner 18 is flexible, anchoring means (not shown) may be provided, if desired, for cooperating with the spa tub or basin 12 in order to keep the disposable water-proof liner 18 in position.

The disposable water-proof liner 18 includes, at a position corresponding to the spa tub or basin drain 34 and the floor trough T2, a drain structure such as a drain opening 18*o* and a drain cap 18*c* (e.g., with the drain structure being disposed in the floor trough). When the drain cap 18*c* is manually opened (and optionally when a drain valve in the pedicure lounge chair 10 is opened), water is free to exit the lined spa tub or basin 12 through the drain opening 18*o*, the drain 34, and the drain line. (The drain cap 18*c* may be a plastic piece separate from the liner body that is press fit thereon, or it may be connected to the liner body via a living hinge. In an alternative embodiment, when the pedicure lounge chair 10 includes a drain valve, it is conceivable that the drain structure of the disposable water-proof liner 18 might only include a drain hole or opening 18*o* and need not include a drain cap 18*c*.)

The gas jet member 20 (120) is or can be a unitary (one piece, or formed from pieces that are joined together), non-electric member made from plastic, metal, or other suitable rigid or substantially rigid material. As shown in FIGS. 2 and 4, the gas jet member 20 (120) and the gas coupling member 42 (142) are both disposed (e.g., in the preferred embodiment, in their operative positions) in (meaning partially or fully within) the wall trough T1 provided in the spa tub or basin 12. This location largely protects the gas jet member 20 (120) and the associated quick-connect coupling (to be described hereinafter) from accidental breakage and/or disconnection due e.g., to leg movements by the spa user before, during, or after the pedicure treatment.

As shown in schematically in FIGS. 3 and 4 (and as will be explained more fully in conjunction with FIGS. 6 and 7), the gas jet member 20 (120) includes an upper end 22 which carries a male-half member of a quick-connect coupling. The male-half member of the quick-connect coupling cooperates with the gas coupling member 42 (142) in the wall of the spa tub or basin for feeding a (pressurized) gas stream such as air to the gas jet member 20 (120). The gas jet member 20 (120) further includes a (generally vertically extending) tubular extension 24 adapted to carry gas from the male-half member of the quick-connect coupling in the upper end 22 to a position below the liquid fill level LFL (FIG. 3) of the spa tub or basin 12 to a gas jet head 26. The gas jet head 26 is disposed at a lower end of the gas jet member 20 and emits a gas stream (carried from the gas supply line 40*a* to the gas coupling member 42, and then through the quick-connect coupling and the tubular extension 24 and to the gas jet head 26) into the spa tub or basin 12. (A length L, FIG. 6A, of the tubular extension 24 of the gas jet member 20, from the quick-connect coupling at the upper end 22 to the gas jet head 26 at the lower end, is between 2 and 12 inches, preferably between 3 and 9 inches, and most preferably between 4 and 6 inches.) The gas stream emitted from the gas jet head 26 may be produced as a ring or rings from multiple radially arranged/oriented jets that may have controlled jetting power (see e.g., FIGS. 6A and 8 to 11, to be described hereinafter).

Figure 5:
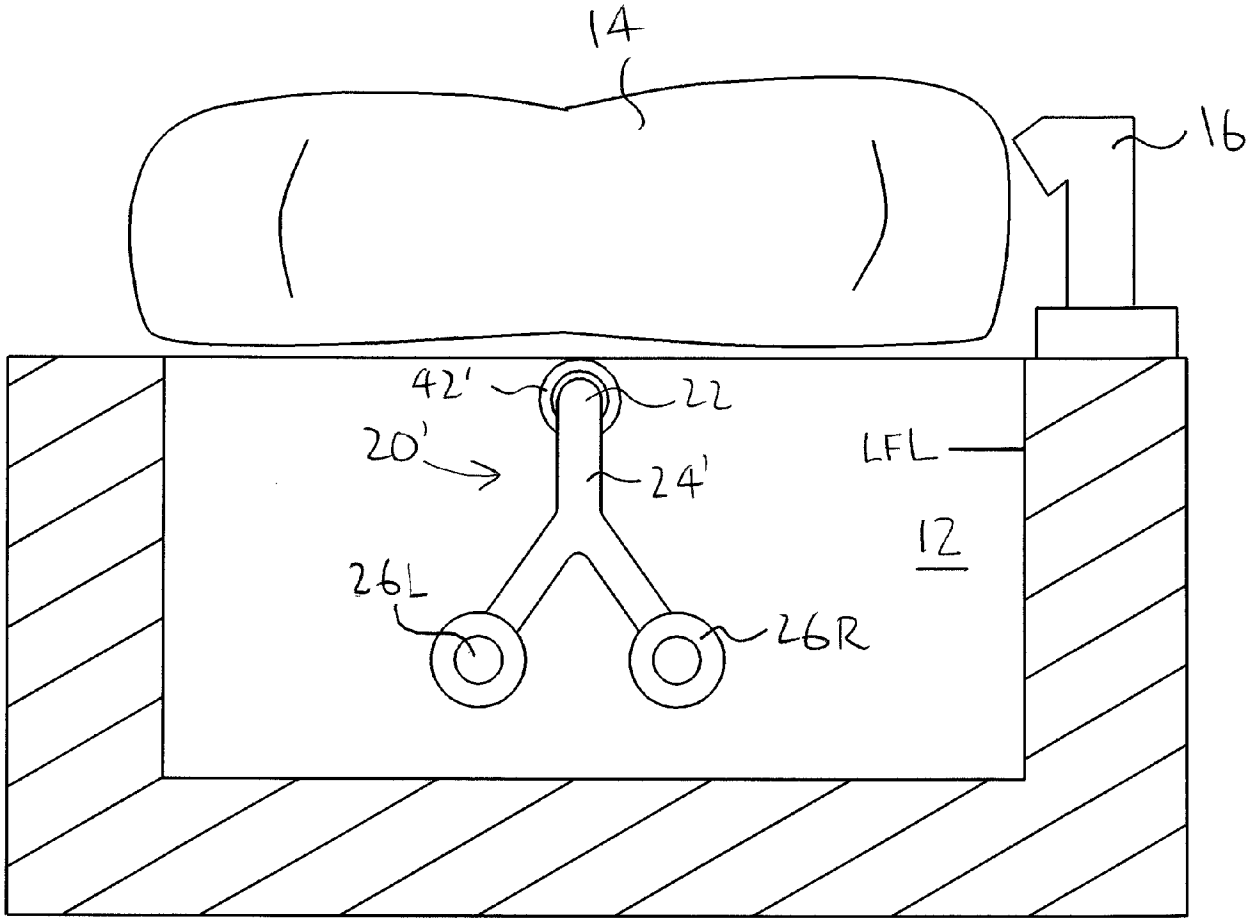
FIG. 5 is a partial transverse cross-section of a modification of the embodiment of the invention shown in FIGS. 1 and 2, e.g., without the disposable liner installed or water present in the spa tub.

In a modification shown in FIG. 5, a gas jet device 20' may be connected to a gas coupling member 42' secured to the peripheral wall 12P of the spa tub or basin 12 (above the liquid fill level LFL) at the end of the spa tub or basin 12 located nearest the foot rest 14. This gas coupling member 42' may be provided in addition to or in place of the gas coupling member 42 (142) of FIG. 4. The gas jet device includes an upper end 22 which carries a male-half member of a quick-connect coupling, a tubular extension 24' which includes left and right branches and is shaped in a form of a symmetrical (upside-down) capital Y, and left and right gas jet heads 26L, 26R which are adapted to provide gas jetting action for the spa user's left and right feet, respectively. Note that FIG. 5 shows an alternative embodiment of the invention where neither a wall trough (for the gas coupling member 42') nor a floor trough (for the drain cap 18*c*) is provided in the spa tub or basin 12.

Figures 6A, 6B:
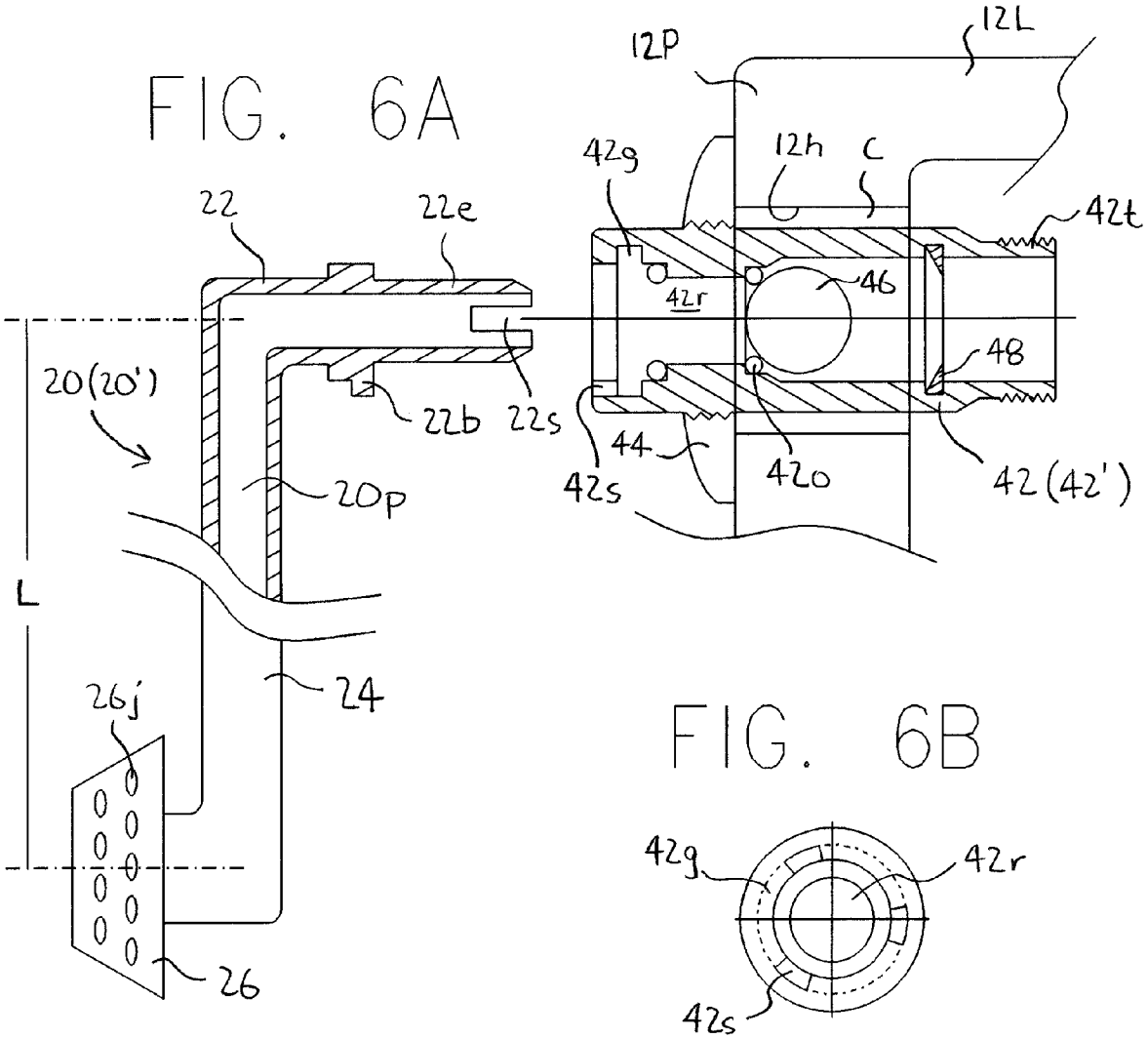
FIG. 6A is a partial cross-section of a gas jet member and a gas coupling member used in the embodiments of FIGS. 1 to 5.
FIG. 6B is a frontal view of the gas coupling member of FIG. 6A.

Referring now to FIGS. 6A and 6B, there is shown a gas jet member 20 (20') and a gas coupling member 42 (42') used in the embodiments of FIGS. 1 to 5. The gas jet member 20 includes an upper end 22 having a hollow longitudinally (e.g., substantially horizontally) extending male-shaped end 22*e* which includes one or more (e.g., 3 equally-spaced) bayonet lugs 22*b* and one or more (e.g., 2) air slots 22*s*, as well as a tubular extension 24. The gas jet head 26 is disposed at the lower end of the gas jet member 20 and is in open fluid communication (through an inner passage 20*p*) with the upper end 22. The gas jet head 26 includes one or more rings of radially arranged (and radially oriented) gas jets 26*j*. The radially arranged jets may be disposed on a forward facing frustoconical peripheral surface of the gas jet head, and/or on a forward facing planar end face of the gas jet head 26, and may be configured to control the jetting power according to a desired fanning-out distribution.

The gas coupling member 42 (42') of FIG. 6A is secured to the peripheral wall 12P of the spa tub or basin 12 by means or caulking C or other suitable means or mechanisms. In particular, the gas coupling member 42 (42') is disposed within a hole or bore 12*h* that extends completely through the peripheral wall 12P, and secured in place by caulking. After it has been secured to the spa basin wall (at a position above the liquid fill level LFL), a decorative finishing ring 44 may be threaded onto the exposed forward end of the gas coupling member 42 (42') for aesthetic purposes. (The finishing ring 44 may include peripheral ridges to facilitate turning by hand, or may include a hexagonal structure or surface, not shown, to facilitate turning by a wrench.) The rearward end of the gas coupling member 42 (42'), which is disposed internally of the pedicure lounge chair 10 (i.e., on the opposite side of the peripheral wall 12P from the finishing ring 44), includes screw threads 42*t* for connecting to the gas supply line 40*a*.

The gas coupling member 42 (42') constitutes the female-half member of a bayonet-type quick-connect coupling and is preferably made from suitable materials such as strong plastic, metal, or a combination of strong plastic and metal. The gas coupling member 42 (42') includes a female-shaped receptacle 42*r*, one or more (e.g., 3 equally-spaced) bayonet slots 42*s*, and a lug retaining groove 42*g*. A valve ball 46 is disposed in the receptacle 42*r* and is retained therein by a snap ring 48.

Before the gas jet member 20 (20') is coupled to the gas coupling member 42 (42'), if there is gas pressure in the gas supply line 40*a*, valve ball 46 will be biased outwardly and seated against a resilient (soft plastic) O-ring 42*o* by the gas pressure, thereby effectively shutting off the flow of gas from the gas coupling member 42 (42').

The gas jet member 20 (20') is coupled to the gas coupling member 42 (42') by aligning the bayonet lugs 22*b* with the bayonet slots 42*s*, inserting the male-shaped end 22*e* of the gas jet member 20 (20') into the receptacle 42*r* of the gas coupling member 42 (42') with a substantially horizontal movement, and then rotating the gas jet member by a small angle (e.g., by ≤30° counter-clockwise in the event that the vertically downwardly extending lug labeled 22*b* in FIG. 6A is aligned with the slot labeled 42*s* in FIG. 6B). In the preferred embodiment, the coupling action occurs when the tubular extension 24 is manipulated into a vertical downward position from a position ≤30° off-vertical, whereby the bayonet lugs 22*b* become retained within the lug retaining groove 42*g*. (Note that the trough T1 has a lateral width larger than that of the gas jet member 20 in order to accommodate an off-vertical orientation of the tubular extension 24 during coupling and uncoupling.) Moreover, since a longitudinal extent of the male-shaped end 22*e* is greater than a distance from the lug retaining groove 42*g* to the seated valve ball 46, this coupling action also lifts the valve ball 46 from its position seated against the O-ring 42*o*, whereby gas can begin to flow from the gas supply line 40*a*, through the open ball-valve and air slots 22*s*, and into the gas jet member 20. As such, the inter-cooperation of the male-shaped end 22*e* with the seated ball valve 46 during coupling of the gas jet member 20 (20') with the gas coupling member 42 (42') constitutes valve opening means for opening the ball-valve provided in the gas coupling member 42 (42'). (It is also envisioned that stops can be provided in the retaining groove 42*g* to stop the rotation of the gas jet member 20 (20') when the tubular extension 24 is in a vertical downward position.)

To uncouple the gas jet member 20 (20') from the gas coupling member 42 (42'), the gas jet member 20 (20') is merely rotated in an uncoupling direction by a small angle (e.g., ≤30° clockwise) so that the bayonet lugs 22*b* can pass back through the bayonet slots 42*s*.

Figure 7A:
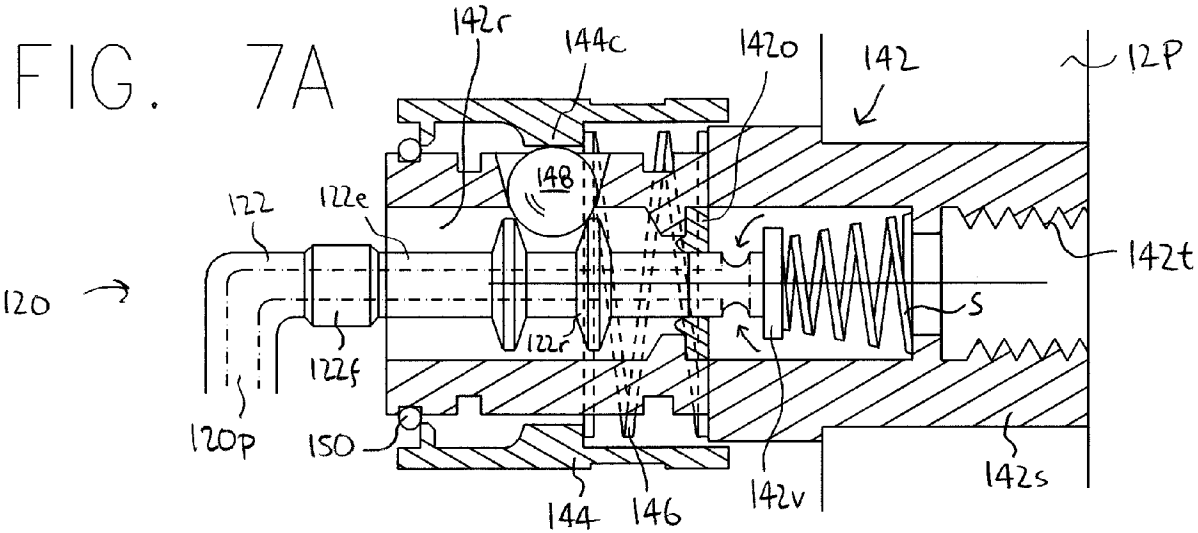
FIG. 7A is a partial longitudinal cross-section of a second quick-connect coupling for the gas jet member and gas coupling member used in the embodiments of FIGS. 1 to 5.

FIG. 7A shows a push (biased sleeve) type quick-connect coupling for the gas jet member 120 and gas coupling member 142 used in the embodiments of FIGS. 1 to 5. While not shown in FIG. 7A, the tubular extension and the gas jet head of the gas jet member 120 are identical to those described in conjunction with the gas jet member 20 (20'). The upper end 122 of the gas jet member 120 includes a hollow longitudinally (e.g., substantially horizontally) extending male-shaped end 122*e* which includes at least one radially enlarged annular retaining ring 122*r* (in the form of an enlargement or projection). A finger grip 122*f* with a friction surface may be provided at the upper end 122 of the gas jet member 120.

The gas coupling member 142 includes a securing end 142*s* which may have a hexagonal periphery and which is adapted to be secured (such as by caulking) to the peripheral wall 12P of the spa tub or basin 12. Internal threads 142*t* are provided in the vicinity of the securing end 142*s* for connecting to the gas supply line 40*a*. A receptacle 142*r* is provided in the gas coupling member 142 for receiving the male-shaped end 122*e* of the gas jet member 120 and for retaining a headed poppet-like valve element 142*v* which is normally biased by a spring S to seat against an O-ring 142*o* (see FIG. 7B).

The gas coupling member 142 further includes a push sleeve 144 which is normally biased by a coil spring 146 into a leftward position where a cam surface 144*c* on the push sleeve 144 engages one or more coupling balls 148 to push the coupling ball(s) 148 radially inwardly e.g., into engagement with the annular retaining ring 122*r* of the gas jet member 120. (In the preferred embodiment of the invention, there are three coupling balls 148.) A snap ring 150 limits leftward movement of the sleeve 144 under the bias of spring 146.

Figure 7B:
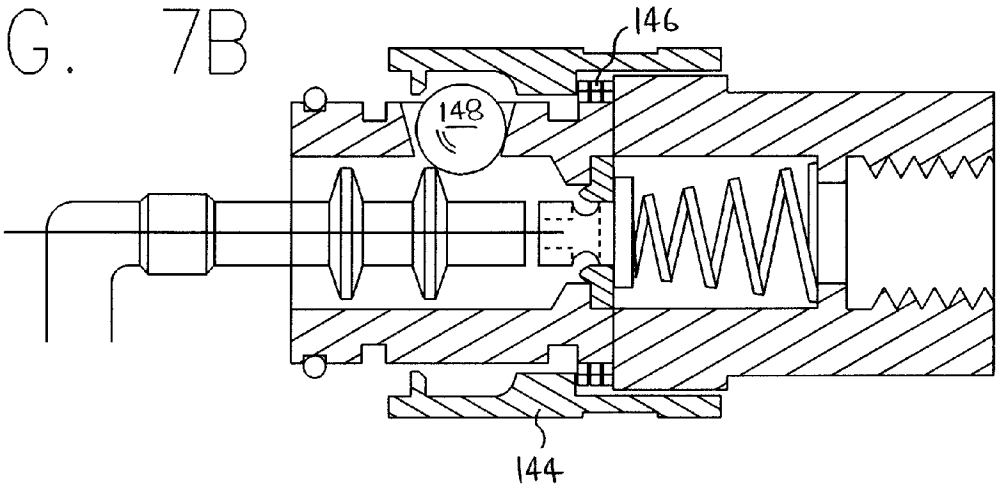
FIG. 7B shows the quick-connect coupling of FIG. 7A in its disconnected condition.
Figure 9:
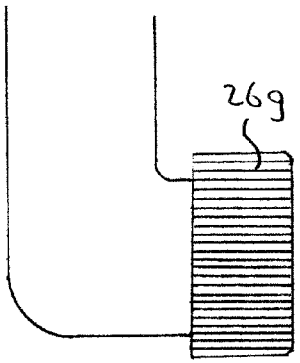
FIG. 9 shows a side view of the gas jet head of FIG. 8.

FIG. 7B shows the state of the gas coupling member 142 and its parts before the gas jet member 120 is coupled to the gas coupling member 142. The head of the valve element 142*v* is biased against the O-ring 142*o* by the spring S so as to shut off the valve and consequently gas communication between the gas supply line 40*a* and the gas jet member 120. In anticipation of coupling, the sleeve 144 has been pushed to the right against the bias of the spring 146, allowing the coupling ball(s) 148 to move radially outwardly.

Next, the male-shaped end 122*e* is inserted into the receptacle 142*r* and pushed with a substantially horizontal movement. The male-shaped end 122*e* thus contacts and pushes the valve element 142*v* against the bias of the spring S, so that the head of the valve element 142*v* is lifted from its seated position against the O-ring 142*o*. (The valve element 142*v* includes radial and axial bores which establish fluid communication from the left side of the valve head to the left end of the valve element when the head of the valve element 142*v* is unseated from the O-ring 142*o*.) This displacement of the valve element 142*v* establishes fluid communication from the gas supply line 40*a*, around the valve head (as indicated by the arrows in FIG. 7A), through the bores of the valve element 142*v* and the inner passage 120*p* of the gas jet member 120. (As such, the inter-cooperation of the male-shaped end 122*e* with the seated valve element 142*v* during coupling of the gas jet member 120 with the gas coupling member 142 constitutes valve opening means for opening the poppet-like valve provided in the gas coupling member 142.) This condition of the valve element 142*v* which establishes fluid communication is shown in FIG. 7A.

Finally, after fluid communication is established, the sleeve 144 is released, locking the coupling ball(s) 148 in their radially inward position and the annular retaining ring 122*r* (and therefore the gas jet member 120) in place. This condition of the sleeve 144, coupling balls 148, and retaining ring 122*r* is also shown in FIG. 7A.

To uncouple the gas jet member 120 from the gas coupling member 142, the sleeve 144 is gripped and pushed to the right against the bias of the spring 146, and the gas jet member 120 is removed from the receptacle 142*r* of the gas coupling member 142.

FIGS. 8 to 11 show a second gas jet head 26' that may be used (e.g., in place of the gas jet head 26) with the gas jet members described previously. In the modification shown in FIGS. 8 to 11, the gas jet head 26' is made from inexpensive plastic, or metal, and takes the form of a control head (similar to an adjustable shower head) which is threaded onto a horizontal lower end portion 24*h* of the tubular extension 24 of the otherwise unitary (and otherwise unchanged from the previous description) gas jet member. The gas jet head 26' includes an internally threaded flange 26*t* that is threadingly received on corresponding external threads provided on the horizontal lower end portion 24*h* of the tubular extension 24. The gas jet head 26' further includes an axial end wall 26*w* that includes gas jets 26*j'* (in the form of holes) extending therethrough. A gripping surface (or finger grips) 26*g* is provided on the periphery of the gas jet head 26' for permitting the gas jet head 26' to be gripped and turned by the spa user.

Figure 8:
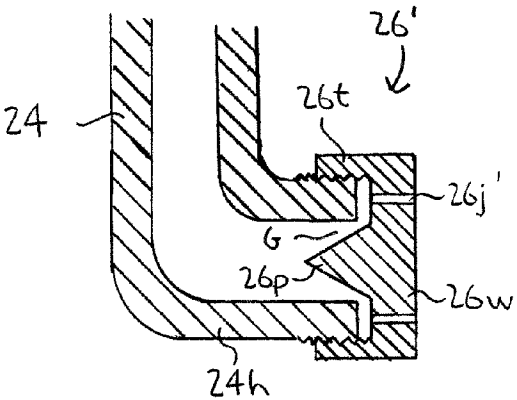
FIG. 8 shows a cross-section of a second gas jet head which can be used in the embodiments of FIGS. 1 to 5.
Figure 11:
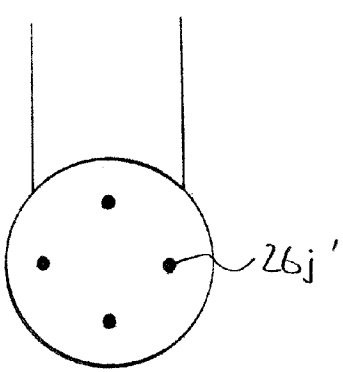
FIG. 11 shows a front view of the gas jet member of FIG. 8.

As will be seen from FIG. 8, an air gap G normally exists between the horizontal lower end portion 24*h* of the tubular member 24 and an inside surface of the axial end wall 26*w* of the gas jet head 26'. (A gas or air guiding projection 26*p* may further be provided on the inside surface of the gas jet head 26'.) When a gas (or air) pressure is present in the tubular conduit 24, gas (or air) will flow through the gap G and be emitted from the gas jets 26*j'* into the spa tub or basin. To control (or shut off) the flow of gas (or air), the gas jet head 26' is simply gripped and rotated on its threads to a position that reduces the size of (or eliminates) the air gap G, thereby reducing the flow of (or cutting off) the gas stream which is emitted from the gas jets 26*j'*. As such, the gas jet head 26' in FIGS. 8 to 11 is threaded onto the tubular extension 24 and defines, together with the tubular extension 24, a manually-operated shut-off valve that can be used to control or shut off the gas (or air) stream to the spa tub or basin 12.

Figure 10:
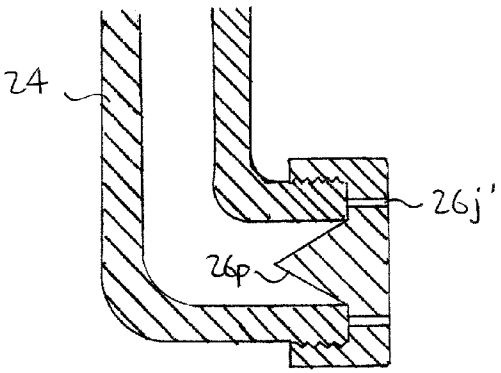
FIG. 10 shows a cross-section of the gas jet head of FIG. 8 with the control head in its closed-position.

FIG. 10 shows the gas jet head 26' in a condition where the gas stream into the spa tub or basin 12 is cut off by rotating the gas jet head 26' so that the air gap G is eliminated, e.g., when the gas jet head 26' is rotated toward the threaded horizontal lower end portion 24*h* of the tubular extension as far as is possible.

The manner in which the spa tub apparatus and system is used will now be explained. First, a disposable water-proof liner 18 is disposed in the spa tub or basin 12 in such a manner that the drain opening 18*o* and drain cap 18*c* covers the spa tub drain 34. The lined spa tub or basin 12 is then filled with water using the water supply outlet or nozzle 16 and the mixer valve 32. Filling of the lined spa tub or basin 12 is stopped when the water reaches the liquid fill level LFL which is below the top edge of the disposable water-proof liner 18. Next, the gas jet member 20 (20'), 120 is quick-coupled (by the spa operator) to the gas coupling member 42, (42'), 142 such that the gas jet member 20, (20'), 120 extends downwardly into the water filled disposable water-proof liner 18. If pressurized gas (air) was already present in the gas supply line 40*a*, the quick-coupling can, by itself, establish pressurized gas (air) flow into water held in the spa tub or basin 12 through the gas jet head(s) 26 (26L, 26R). If pressurized gas (air) was not already present in the gas supply line 40*a*, a manually-operated switch (not shown) on the pedicure lounge chair 10 can be actuated to initiate or control the presence of gas pressure in the gas supply line 40*a*, which pressure will then be fed (as bubbles) into the water held in the by the spa tub or basin 12. Pedicure spa treatment with an air jetting function giving a pleasant sensation to the user can then be performed. In the event that the second gas jet head 26' of FIGS. 8 to 11 is being utilized, the amount of air jetting can additionally be controlled (or shut off) by the spa user simply by rotating the gas jet head 26' using the finger grips 26*g* until the desired level of air jetting is attained.

Upon completion of the pedicure spa treatment with the air jetting function, the drain cap 18*c* in the disposable water-proof liner 18 can be opened and the spa tub or basin 12 drained. Following this, the gas jet member 20, (20'), 120 can be uncoupled from the gas coupling member 42, (42'), 142. If the gas jet member 20, (20'), 120 is an inexpensive piece (made, for example, from plastic), the gas jet member can be disposed of or recycled, thereby minimizing the potential for epidemic outbreaks of bacteria and fungus. If the gas jet member 20, (20'), 120 is of a more durable construction (made, for example, from metal), the gas jet member 20, (20'), 120 may instead be cleaned and sanitized and/or sterilized for reuse. Similarly, the disposable water-proof liner 18 can be removed and e.g., disposed of, again minimizing the potential for epidemic outbreaks of bacteria or fungus.

As used herein, a "quick-connect" coupling is a coupling that can be securely connected in a final connected state by either simple axial movements or by axial movement with up to a half-turn of rotational movement, including such kinds of couplings as have been described and cited herein. The secure connection is a positive (as opposed to frictional) connection, such as is effected by bayonet lugs or coupling balls.

As used herein, a "liquid fill level" does not imply the actual presence of liquid, but merely a position, height, or level to which a liner, basin, or lined basin is intended or designed to be filled with liquid.

A "tubular extension" of the gas jet member 20, (20'), 120 may have a round cross-section, or any other closed-form (e.g., rectangular) cross-section.

"Male" and "female" shapes shall have their normal meanings, including a projection and a receptacle, respectively, which are to be interengaged or mated together. It is not necessary that the male and female parts be sealed directly together, as intermediary parts may perform the sealing function.

While the above invention has been described with certain particularity, it is not meant to be limited to the above described preferred embodiments. For example, other known (e.g., adjustable and/or controllable and/or specially-configured) gas jet heads could be used in place of the gas jet heads 26, 26'. Therefore, the invention will encompass the preferred embodiments described above as well as any modifications thereof which will fall within the scope of the appended claims.

I claim:

1. A sanitary apparatus for use with a spa basin having a spa basin wall including a peripheral wall portion and a bottom wall portion, a gas source, a gas coupling member disposed in the spa basin wall above a liquid fill level, and a spa basin drain disposed in the bottom wall portion for draining liquid from the spa basin, the sanitary apparatus comprising:

a disposable water-proof liner adapted to conform to a shape of the spa basin wall, the disposable water-proof liner being adapted to extend above the liquid fill level and including a drain structure cooperating with the spa basin drain; and a gas jet member adapted to be quickly coupled to the spa basin gas coupling member in the spa basin wall, the gas jet member including:

a quick-connect coupling member at one end thereof for cooperating with the gas coupling member in the spa basin wall said quick-connect coupling member including a hollow male-shaped member which is adapted to be received within the gas coupling member, and wherein the gas coupling member is secured within a hole that extends completely through the peripheral wall portion;

a tubular extension adapted to carry gas from the quick-connect coupling member to a position below the liquid fill level; and a gas jet head connected to the tubular extension and adapted to emit a gas stream carried from the tubular extension of the gas jet member into the spa basin.

2. The sanitary apparatus as recited in claim 1, wherein the gas jet member is a unitary member formed entirely from plastic.

3. The sanitary apparatus as recited in claim 2, wherein a length of the gas jet member, from the quick-connect coupling member to the gas jet head, is between 3 and 9 inches.

4. A sanitary apparatus for use with a spa basin having a spa basin wall including a peripheral wall portion and a bottom wall portion, a gas source, a gas coupling member disposed in the spa basin wall above a liquid fill level, and a spa basin drain disposed in the bottom wall portion for draining liquid from the spa basin, the sanitary apparatus comprising:

a disposable water-proof liner adapted to conform to a shape of the spa basin wall, the disposable water-proof liner being adapted to extend above the liquid fill level and including a drain structure cooperating with the spa basin drain; and a gas jet member adapted to be quickly coupled to the spa basin gas coupling member in the spa basin wall, the gas jet member including:

a quick-connect coupling member at one end thereof for cooperating with the gas coupling member in the spa basin wall;

a tubular extension adapted to carry gas from the quick-connect coupling member to a position below the liquid fill level; and a gas jet head connected to the tubular extension and adapted to emit a gas stream carried from the tubular extension of the gas jet member into the spa basin wherein the gas jet head is threaded onto the tubular extension and defines, together with the tubular extension, a manually-operated shut-off valve.

5. The sanitary apparatus as recited in claim 1, wherein the quick-connect coupling member includes at least one radially projecting bayonet lug adapted to be received within a bayonet slot in the gas coupling member in the spa basin wall.

6. The sanitary apparatus as recited in claim 1, wherein the quick-connect coupling member includes an annular radial projection adapted to engage coupling balls of the gas coupling member in the spa basin wall.

7. The sanitary apparatus as recited in claim 2, wherein the gas jet member includes left and right gas jet heads, and wherein the tubular extension includes left and right branches.

8. The sanitary apparatus as recited in claim 7, wherein the tubular extension is shaped in a form of a symmetrical capital Y.

9. A spa tub apparatus comprising:

a spa basin having a basin wall and a gas source, wherein the spa basin wall includes a peripheral wall portion and a bottom wall portion, and wherein the spa basin is adapted to be filled to a liquid fill level and further includes:

a gas coupling member secured in the spa basin wall above the liquid fill level and connected to the gas source, and a drain disposed in the bottom wall portion for draining liquid from the spa basin;

a disposable water-proof liner adapted to conform to a shape of the spa basin wall, the disposable water-proof liner including a drain structure cooperating with the spa basin drain; and a gas jet member adapted to be quickly coupled to the spa basin gas coupling member in the spa basin wall, the gas jet member including:

a quick-connect coupling member at one end thereof for cooperating with the gas coupling member in the spa basin wall;

a tubular extension adapted to carry gas from the quick-connect coupling member to a position below the liquid fill level; and a gas jet head connected to the tubular extension and adapted to emit a gas stream carried from the tubular extension of the gas jet member into the spa basin wherein the gas jet head is threaded onto the tubular extension and defines, together with the tubular extension, a manually-operated shut-off valve.

10. The spa tub apparatus as recited in claim 9, wherein the gas coupling member is secured to the spa basin wall within a hole that extends completely through the peripheral wall portion.

11. The spa tub apparatus as recited in claim 9, wherein a wall trough is defined as a recess in a major plane of the peripheral wall portion of the spa basin, and wherein the quick-connect coupling member of the gas jet member is disposed in the wall trough when the gas jet member is coupled to the spa basin gas coupling member.

12. The spa tub apparatus as recited in claim 9, wherein a wall trough is defined as a recess in a major plane of the peripheral wall portion of the spa basin, and wherein the tubular extension of the gas jet member is disposed in the wall trough when the gas jet member is coupled to the spa basin gas coupling member.

13. The spa tub apparatus as recited in claim 9, wherein the spa basin gas coupling member includes a hollow female-shaped member, wherein a wall trough is defined as a recess in a major plane of the peripheral wall portion of the spa basin, and wherein the hollow female-shaped member is disposed at least partly in the wall trough defined by the recess in the major plane of the peripheral wall portion.

14. The spa tub apparatus as recited in claim 9, wherein a floor trough is defined as a recess in a major plane of the bottom wall portion of the spa basin, and wherein the drain structure of the disposable water-proof liner is disposed at least partly in the floor trough defined by the recess in the major plane of the bottom wall portion.

15. The spa tub apparatus as recited in claim 9, wherein the gas jet member is a unitary member formed entirely from plastic, and wherein a length of the gas jet member, from the quick-connect coupling member to the gas jet head, is between 3 and 9 inches.

16. The spa tub apparatus as recited in claim 9, wherein the quick-connect coupling member includes a hollow male-shaped member, wherein the spa basin gas coupling member includes a hollow female-shaped member, and wherein the quick-connect coupling member is adapted to be received within the gas coupling member in the spa basin wall.

17. The spa tub apparatus as recited in claim 16, wherein the quick-connect coupling member includes valve opening means for opening a valve provided in the gas coupling member in the spa basin wall.

18. The spa tub apparatus as recited in claim 9, wherein the gas jet member includes left and right gas jet heads, and wherein the tubular extension includes left and right branches.

* * * * *